United States Patent [19]

Dumont et al.

[11] Patent Number: 4,516,426

[45] Date of Patent: May 14, 1985

[54] INSPECTION DEVICE FOR THE TUBE PLATE OF A HEAT EXCHANGER

[75] Inventors: Pascal G. Dumont, Chatenoy-le-Royal; Daniel M. Chiron, Chalon-sur-Saone, both of France

[73] Assignee: Framatome & Cie, Courbevoie, France

[21] Appl. No.: 474,095

[22] Filed: Mar. 10, 1983

[30] Foreign Application Priority Data

Mar. 26, 1982 [FR] France ..... 82 05170

[51] Int. Cl.[3] ..... G01N 21/29

[52] U.S. Cl. ..... 73/432 R; 356/241

[58] Field of Search ..... 73/432 R, 432 B; 350/506; 356/241; 324/220; 73/622, 623

[56] References Cited

U.S. PATENT DOCUMENTS

| | | | |
|---|---|---|---|
| 2,587,476 | 2/1952 | Huhn | 356/241 |
| 3,285,122 | 11/1966 | Buchbinder | 350/506 |
| 4,306,459 | 12/1981 | Johnson et al. | 73/623 |
| 4,389,611 | 6/1983 | Pigeon | 324/220 |

FOREIGN PATENT DOCUMENTS

| | | | |
|---|---|---|---|
| 2758110 | 5/1979 | Fed. Rep. of Germany | 73/432 B |

*Primary Examiner*—S. Clement Swisher

*Attorney, Agent, or Firm*—Pollock, Vande Sande & Priddy

[57] ABSTRACT

The invention relates to an inspection device for the tube plate of a heat exchanger. It comprises a motive part (2) mounted on a support equipped with fixing means to the inlet face of the tube plate. The motive part (2) is driven in rotation and in translation along the axis of the tubes. The device also comprises an active part (1) carrying an inspection probe (10) and guide means (17) for the probe (10) in the tubes. The active part (1) consists of a central shaft (8) and at least one sleeve (14) mounted rotatably on the shaft (8). The sleeve (14) comprises, in its side wall, at least two sets, spaced along the axial direction, of three orifices (15) placed at 120°. Each of the orifices (15) contains a ball (17) projecting outwards. The active part (1) is connected to the motive part (2) by an articulation (3) permitting a disalignment between the active part (1) and the motive part (2). The invention is applicable particularly to the inspection of the defects under casing of a tube plate of a steam generator of a pressurized water nuclear reactor, with a Foucault current probe.

4 Claims, 2 Drawing Figures

INSPECTION DEVICE FOR THE TUBE PLATE OF A HEAT EXCHANGER

FIELD OF THE INVENTION

The invention relates to an inspection device for the tube plate of a heat exchanger.

BACKGROUND OF THE INVENTION

Heat exchangers, such as the steam generators of pressurized water nuclear reactors, comprise a tube plate of great thickness, upon which the tube bank is mounted.

The tubes of the bank pass through the plate from its inlet face in contact with the primary fluid to its outlet face in contact with the secondary fluid.

In the steam generators of pressurized water nuclear reactors, the primary water enters the water chest, one of the walls of which is formed by the inlet face of the tube plate, with which the ends of the tubes are flush.

Feed water is introduced into the part of the steam generator located above the tube plate and comes into contact with the tubes of the bank, within which the primary fluid circulates. The heat of the primary fluid permits the vaporization of the feed water.

The outlet face of the tube plate is covered by a stainless casing.

After the assembly of the tube bank, it is necessary to inspect the state of the tube plate, and particularly to inspect the zone of this tube plate located beneath the casing, since defects can appear in this zone.

The inspection must be performed from the water chest of the steam generator, i.e., from the inlet face of the tube plate.

Inspection probes must therefore be introduced successively into each of the tubes passing through the tube plate in order to perform the inspection of the zone located close to the outlet face of the tube plate, around the relevant tube.

The probes must therefore be capable of moving in translation within the tue over the total span of the tube plate, this span being of the order of 600 mm, and in rotation about the axis of the tube, in order to perform the inspection of the portion of the tube plate located around the tube.

Inspection devices for the tubes of a steam generator are known, consisting of an assembly capable of moving in translation in the tube by virtue of a cable possessing sufficient rigidity to exert a thrust upon the inspection device. This device can be introduced into each of the tubes successively, and comprises a support equipped with fixing means to the inlet face of the tube plate.

Since the objective is to facilitate the passage of the inspection device along the entire length of the tube, which is bent in a U shape at its top end, the active part of the device comprising the inspection probe exhibits guide means permitting this active part to follow the curvature of the tube.

However, it is impossible in this way to ensure very good centering of the probe in the tube.

In the case of the inspection of the defects under the casing of the tube plate, such devices are not satisfactory, because the prime consideration is a perfect centering of the probe at the level of the outlet face of the tube plate, since the probe is then set in rotation about the axis of the tube in order to inspect the zone of the tube plate located at the periphery of the tube.

Moreover, in the prior art devices, the means of moving the probe must be placed in the prolongation of the axis of the tube so that the thrust permitting the movement of the inspection device can be exerted in the correct direction.

For the inspection of the tube plate, at the level of the peripheral tubes which are very close to each other, it is impossible to ensure an appropriate arrangement of the means of moving the probe. This is due to the domed shape of the end of the steam generator forming the outer wall of the water chest.

SUMMARY OF THE INVENTION

It is therefore an objective of the invention to propose an inspection device for the tube plate of a heat exchanger, upon which a bank of tubes is mounted passing through the plate from its inlet face with which the tubes are flush to its outlet face through which the tubes of the bank emerge, comprising a motive part mounted on a support equipped with fixing means to the inlet face of the tube plate and driven in rotation and in translation along the axis of the tubes by driving means fixed to the support and an active part comprising an inspection probe and guide means for the probe within the tubes, the inspection of the tube plate being performed from the inside of each of the tubes of the bank successively, this inspection device permitting perfect centering of the probe in the tubes and the inspection of the peripheral zone of the tube plate, in spite of the domed shape of the end of the heat exchanger.

With this object, the active part of the device consists of a central shaft carrying the probe rigidly, and of at least one guide sleeve for the device mounted rotatably on the central shaft, about the axis of this shaft coincident with the axis of the tube into which the active part of the device is introduced, the sleeve comprising in its side wall at least two sets, spaced in the axial direction, of three orifices arranged at 120°, each containing a ball projecting outwards and mounted rotatably for rolling on the inner surface of the tubes, and the active part is connected to the motive part by an articulation permitting a disalignment between the axis of the active part and the axis of rotation of the motive part.

BRIEF DESCRIPTION OF THE DRAWINGS

In order that the invention may be more clearly understood, two embodiments of an inspection device according to the invention, suitable for use for the inspection of the tube plate of a steam generator of a pressurized water nuclear reactor, will now be described by way of examples, with reference to the accompanying drawings, in which:

FIG. 1 shows the end of an inspection device acording to the invention comprising the active part 1 thereof, the end 2 of the motive part and the articulation 3 forming the joint between the motive part and the active part.

Figure 1:
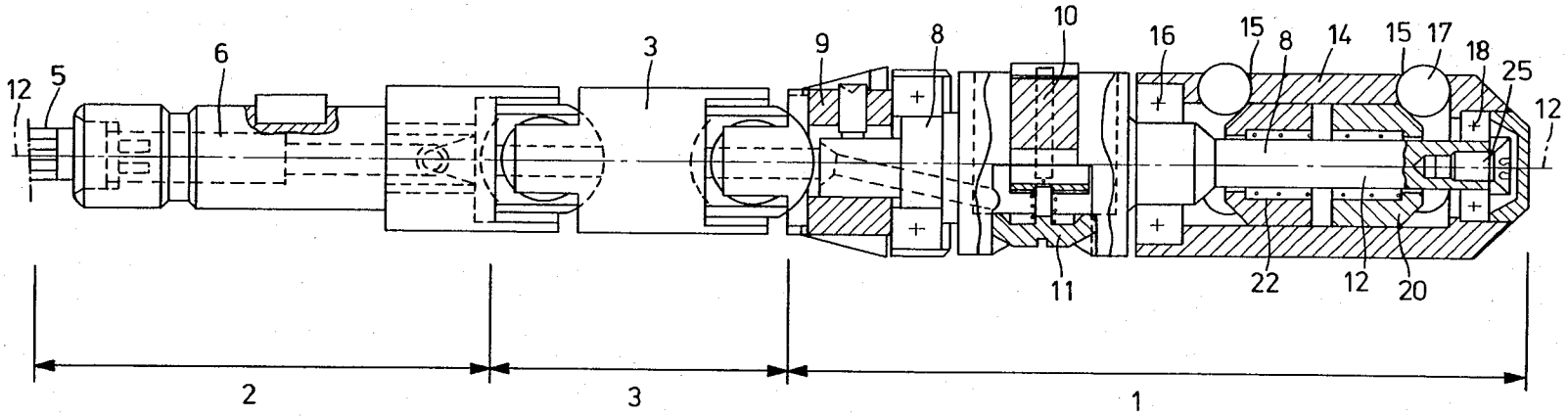
FIG. 1 shows the end of an inspection device according to the invention, in a view with partial section through a plane of symmetry.

The motive part comprises a cable 5 of sufficient rigidity to exert a thrust upon the inspection device and to drive it in rotation inside a tube. The cable 5 serving to supply the probe and to collect information from this probe is connected to a junction part 6 which is itself connected with articulation to the active part 1 through the intermediary of the part 3.

The part 3 is constructed in the form of a double cardan joint permitting the movements of rotation and of translation of the cable 5 to be transmitted to the part 1 of the inspection device, even in the case where certain disalignment exists between the motive part and the active part of the inspection device.

The active part of the inspection device comprises a central shaft 8 connected through the intermediary of a junction part 9 to the articulation 3.

A Foucault current probe 10 is attached to a widened part of this shaft 8 by means of a screw 11. The probe 10 is thus firmly fixed to the central shaft 8.

A sleeve 14 is mounted on the end of the shaft 8 rotatably about the axis 12 of the device by virtue of ball bearings 16 and 18.

The sleeve 14 comprises orifices 15, each receiving a ball 17 maintained slightly projecting with reference to the outer surface of the sleeve 14, by virtue of an annular dome 20 in two parts maintained mutually spaced by a spring 22.

The orifices 15 permit the balls to be maintained inside the sleeve 14, while leaving them mobile in rotation inside their housing.

The orifices 15 are arranged in three rows of axial direction arranged at 120° on the lateral surface of the sleeve 14.

The outside diameter of the ball sleeve thus constituted corresponds exactly to the inside diameter of the tubes of the bank, so that this ball sleeve can perform a perfect guidance of the active part of the inspection device inside the tube.

In fact, the two sets of three balls at 120° spaced along the axial direction of the active part 1 permit a perfect centering of this active part, and hence of the probe 10, inside the tube and independently of any other guide element.

A screw 25 permits the assembly of the active part of the inspection device.

Figure 2:
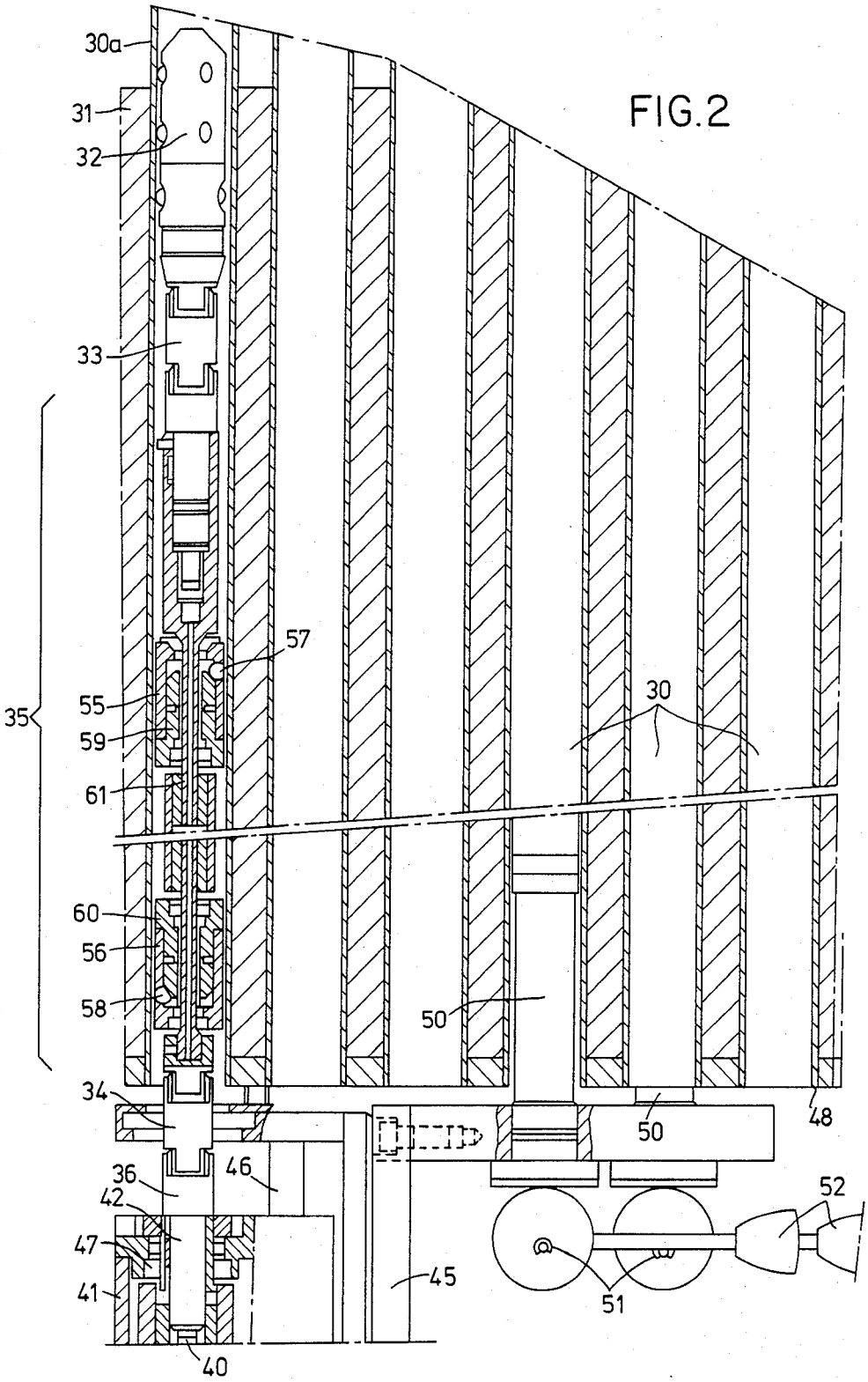
FIG. 2 shows a second embodiment of the device according to the invention in working position inside a tube plate of great thickness.

The inspection device illustrated in FIG. 2, in the working position inside a tube 30*a* passing through the tube plate 31 of a steam generator of very great thickness, comprises an active part 32 and an articulation 33, identical in all respects with the active part 1 and with the articulation 3 illustrated in FIG. 1.

In order to permit better guidance of the inspection device inside the tube in its passage through the thick plate, the connection part 36 of the motive part of the inspection device is connected to the articulation 33 through the intermediary of a second articulation part 34 and of an intermediate guide assembly 35.

In the device illustrated in FIG. 1, the intermediate connecting part 6 equivalent to the part 36 was connected directly to the articulation part 3 equivalent to the articulation part 33.

The intermediate connection device 35 permits better guidance of the inspection device inside the tube plate.

The motive part of the inspection device consists of a rigid cable 40 for the supply of the probe and the collection of information connected to the connecting part 36, which is itself mounted movably in rotation about the axis 42 inside a support device 41.

The support 41 is mounted movably in translation in the direction of the axis 42, upon a fixed support 45 by virtue of a guide column 46.

Motor means permit the motive part of the inspection device to be set in rotation about the axis 42, and other motor means permit the movement in translation of the assembly 41 upon which the motive part is mounted rotatably through the intermediary of a roller bearing 47.

The support 45 is fixed to the inlet face 48 of the tube plate 31 by two mandrels 50 engaged in tubes 30 of the bank arranged close to the tube 30*a* in which the inspection is performed and maneuvered by eccentrics 51 firmly attached to actuating handles 52.

The inspection assembly can thus be moved from one zone to another of the tube plate and fixed to the latter for the inspection of the tube plate through the inside of the tubes arranged in the corresponding zone.

The guide assembly 35 comprises, in addition to the extreme parts connecting to the articulations 33 and 34, two guide sleeves 55 and 56 each comprising three orifices at 120° containing balls 57 and 58 maintained slightly projecting with reference to the outer surface of the sleeves 55 and 56 by domes 59 and 60. The sleeves 55 and 56 are mounted rotatably on a central shaft 61 through the intermediary of roller bearings.

The central shaft 61 is connected at each of its ends to one of the connecting parts of the guide part 35 with the articulations 33 and 34.

The device according to the invention permits perfect guidance and centering of the probe inside the tube in which it is engaged, by virtue of the two sets of three balls at 120° spaced along the length of the guide sleeve of the active part of the device.

In the case of a plate of great thickness, as shown in FIG. 2, the guidance is further improved by providing other guide sleeves between the motive part and the active part of the device.

The guidance of the device inside the tube is furthermore totally independent of the rotational and translational driving means attached to the support fixed to the inlet face of the tube plate.

A disalignment may exist between the axis of the motive part and the axis of the active part, by virtue of the cardan joints connecting these two parts of the device.

In particular, for the inspection of the peripheral part of the tube plate, the device according to the invention permits the inspection device to be moved in translation and in rotation, while placing the driving means of the device slightly towards the inside of the tube plate. It is therefore possible to reach the peripheral tubes of the tube plate in spite of the domed shape of the end closing the water chest of the steam generator.

One may conceive of the use of a guide part of any length composed of any number of sleeves according to the thickness of the tube plate to be inspected.

One may also conceive of any rotational and translational movement means of the motive part of the device; this motive part may consist of a rigid connecting part to which a cable is attached, or of a rigid cable driven in translation and in rotation.

In the case of the inspection of the defects under casing of a tube plate of great thickness, a Foucault current probe is preferably used, but it is likewise possible to use the device according to the invention for the movement of any probe permitting the inspection of a tube plate.

Lastly, the device according to the invention may be used not only for the inspection of tube plates of steam generators of pressurized water nuclear reactors, but also for the inspection of tube plates of other types of heat exchangers.

We claim:

1. Inspection device for the tube plate of a heat exchanger upon which a bank of tubes is mounted passing through said plate from its inlet face (48) with with said tubes (30) are flush to its outlet face through which said tubes (30) of said bank emerge, comprising a motive part (5, 40) mounted on a support (41) equipped with fixing means (50, 51, 52) to said inlet face (48) and driven in rotation and in translation along the axis of said tubes by driving means fixed to said support (41), and an active part (1, 32) comprising an inspection probe (10) and guide means (17) for said probe within said tubes (30), the inspection of said tube plate being performed from the inside of each of said tubes (30) of said bank successively, wherein said active part (1, 32) consists of a central shaft (8) rigidly carrying said probe (10), and at least one guide sleeve (14) for said device mounted rotatably on said central shaft (8), about the axis of said shaft (8) coincident with the axis of said tube (30) into which said active part is introduced, said sleeve (14) comprising in its side wall at least two sets, spaced in axial direction, of three orifices (15) arranged at 120° and each containing a ball (17) projecting outwards and mounted rotatably for rolling on the inner surface of said tube (30), said active part (1) being connected to said motive part (5) by an articulation (3) permitting disalignment between the axis of said active part (1, 32) and the axis of rotation of said motive part (5, 40).

2. Inspection device according to claim 1, wherein a guide assembly (35) is arranged between said motive part (40) and said active part (32), said guide assembly containing at least one guide sleeve (55, 56) mounted rotatably on an intermediate central shaft (61) oriented along the axis of said tube (30*a*) and comprising in its side wall orifices at 120°, each containing a ball projecting outwards (57, 58) for rolling on the inner surface of said tube (30*a*), said intermediate central shaft (61) being connected at its end through the intermediary of articulations (33, 34) to said motive part (40) and to said active part (32), respectively.

3. Inspection device according to claim 1 or 2, in the case of inspection of the zone located beneath the casing of the outlet face of a tube plate of a steam generator of a pressurized water reactor, wherein said probe is a Foucault current probe.

4. Inspection device according to claim 1 or 2, wherein the motive part of said device comprises a rigid cable (5, 40).

* * * * *